US007310825B2

(12) United States Patent
St-Germain

(10) Patent No.: US 7,310,825 B2
(45) Date of Patent: Dec. 25, 2007

(54) GARMENT ELEMENT WITH AN ACCESS OPENING

(76) Inventor: Gilles St-Germain, 120 Elmiré, Montréal, QBC (CA) H2T 1J8

( * ) Notice: Subject to any disclaimer, the term of this patent is extended or adjusted under 35 U.S.C. 154(b) by 113 days.

(21) Appl. No.: 11/127,164

(22) Filed: May 12, 2005

(65) Prior Publication Data

US 2006/0101554 A1 May 18, 2006

Related U.S. Application Data

(60) Provisional application No. 60/627,948, filed on Nov. 16, 2004.

(51) Int. Cl.
*A41B 7/00* (2006.01)
*A41B 1/08* (2006.01)
*A41D 27/10* (2006.01)

(52) U.S. Cl. ..... 2/123; 2/125; 2/270

(58) Field of Classification Search ..... 2/123, 2/121, 128, 275, 158, 159, 59, 60, 162, 170, 2/270, 125
See application file for complete search history.

(56) References Cited

U.S. PATENT DOCUMENTS 531,179 A * 12/1894 Gilbert ..... 450/36
1,397,579 A * 11/1921 Guinzburg ..... 2/401
1,929,385 A * 10/1933 Jensen ..... 2/161.8
2,003,217 A * 5/1935 Oathout ..... 2/121
2,335,664 A * 11/1943 Goldman et al. ..... 2/74
2,368,272 A * 1/1945 Sydenham et al. ..... 2/458
2,506,094 A * 5/1950 Macrides ..... 2/121
2,803,824 A * 8/1957 Parish ..... 2/69.5
3,059,602 A * 10/1962 Russell et al. ..... 112/433
3,090,047 A * 5/1963 De Grazia ..... 112/425
3,218,652 A * 11/1965 Madnick et al. ..... 2/270
3,221,344 A * 12/1965 Rokus ..... 2/16
4,177,812 A * 12/1979 Brown et al. ..... 604/390
4,183,100 A * 1/1980 De Marco ..... 2/159
4,208,743 A * 6/1980 Whitcraft ..... 2/104
4,461,030 A * 7/1984 Knudsen ..... 224/222
4,601,068 A * 7/1986 Frechette ..... 2/104
4,742,580 A * 5/1988 Phillips et al. ..... 2/158
4,757,559 A * 7/1988 Zanoni ..... 2/275
4,961,418 A * 10/1990 McLaurin-Smith ..... 602/21
4,967,419 A 11/1990 Elliot
5,029,345 A * 7/1991 Angheluta et al. ..... 2/403
5,142,704 A * 9/1992 Viemeister et al. ..... 2/202
5,504,944 A 4/1996 Bromer et al.
5,628,062 A 5/1997 Tseng
5,669,078 A * 9/1997 Scremin et al. ..... 2/247
5,678,248 A 10/1997 Lengyel
5,794,265 A * 8/1998 Reich ..... 2/125
5,827,207 A * 10/1998 MacMorran ..... 602/5
5,878,435 A 3/1999 Kast et al.
D410,957 S * 6/1999 Hubsher ..... D2/623
5,913,408 A * 6/1999 Shanahan ..... 2/90

(Continued)

*Primary Examiner*—Gary L. Welch
*Assistant Examiner*—Jena A Sold
(74) *Attorney, Agent, or Firm*—Equinox Protection; Franz Bonsang, Patent Agent

(57) ABSTRACT

In a garment element, for example a cuff for a sleeve, an access opening is defined between an overlap section extending between two attachment sections, the overlap section being formed of interleaving fabric ends suitably stiffened to provide a self-sealing function in both a use mode in which a body member extends there through and a non-use mode with the opening closed.

18 Claims, 4 Drawing Sheets

U.S. PATENT DOCUMENTS 6,076,189 A * 6/2000 Christman et al. ..... 2/158
6,249,916 B1 * 6/2001 Mellon et al. ..... 2/125
6,418,561 B1 7/2002 Gregory
6,418,563 B1 * 7/2002 Turner ..... 2/239
6,449,772 B1 * 9/2002 Donner ..... 2/170
6,571,432 B1 * 6/2003 Rindle ..... 24/432
6,826,782 B2 * 12/2004 Jordan ..... 2/94
6,839,911 B1 * 1/2005 Mathews ..... 2/93
2003/0115654 A1 6/2003 Gregory et al.
2004/0064870 A1 * 4/2004 Gold ..... 2/158
2005/0172381 A1 * 8/2005 Bush et al. ..... 2/249

* cited by examiner

GARMENT ELEMENT WITH AN ACCESS OPENING

CROSS REFERENCE TO RELATED APPLICATION

This application is related to U.S. provisional application for patent Ser. No. 60/627,948 filed on Nov. 16, 2004.

FIELD OF THE INVENTION

The present invention relates in general to garments, and in particular to self-closable access openings provided in garments and the like, such as an opening for the thumb of the wearer to selectively extend outside a garment element such as a sleeve cuff.

BACKGROUND OF THE INVENTION

Cuffs are well known in the art of clothing manufacture and are commonplace in the form of arm, wrist and ankle apertures in most garments. These cuffs may come in a variety of forms and can be sealed in several ways including button closure, elastic band closure, lateral zipper closure, rivet snap closure, etc. The main function of all these closure systems is to create a seal around the arm, wrist or ankle of the wearer without covering their respective extremities, the objective being to offer some protection to the arms and legs of the wearer. In the event of inclement weather or where insect presence proves problematic, it would be advantageous to have a cuff which could be extended over the palm of the hand and being provided with an aperture through which the thumb would protrude, thus allowing the wearer full use of the hand as well as affording a greater degree of protection from the elements and/or insects. Such a cuff would additionally be provided with an elastic band closure system at the cuff's distal extremity for maximal protection. The thumb aperture or opening, when unused, is typically not sealed and leaves the area of the cuff unprotected against rain, wind, insects and the like which may prove undesirable.

Obviously, such openings could also be found at different locations on garments to serve different purposes, all having the same non-protective drawbacks against all or some of the above elements.

Accordingly, there is a need for an improved garment element with a self-closable through-access opening.

SUMMARY OF THE INVENTION

It is therefore a general object of the present invention to provide an improved garment element with an access opening.

An advantage of the present invention is that the garment element has an access opening that is readily accessible without any dedicated closure and/or seal mechanism for selective use whenever required.

Another advantage of the present invention is that the garment element has an access opening that can be located adjacent to provide for a thumb port allowing the wearer full use of his partially covered hand.

Yet another advantage of the present invention is that the garment element with an access opening provides for, by virtue of a unique overlapping design and stitching pattern or the like, an easy access for the thumb and is maximal in its capacity of deflecting water and wind as well as excluding insects from accessing the interior of the garment, in both used (all around the interface with the thumb extending there through) and unused configurations.

Another advantage of the present invention is that the garment element has an access opening that is substantially self-closable and self-sealable when the thumb or the like is withdrawn there from or extending there through, thereby providing further maximal protection from weather and insects, and its construction orientation prevent accumulation of water there around and infiltration of wind there through in normal use configuration of the garment.

Still a further advantage of the present invention is that the garment element with an access opening used adjacent a cuff can have its construction fabric extending there from to cover the palm side surface of the cuff as a reinforcement fabric, especially when the garment is destined for labor or sport-related activity.

Another advantage of the present invention is that the garment element with an access opening is simple and inexpensive of construction, and substantially almost invisible to the eye when unused.

According to an aspect of the present invention, there is provided a garment element comprising first and second fabric ends extending in generally opposite first and second directions; an elongate access opening defined by the fabric ends and extending between two longitudinally opposite opening sides, and including: an overlap section extending between two attachment sections, each forming a respective opening side, said overlap section having a first fabric end unfolded portion extending transversely into the first direction and a first fabric end folded portion folded inwardly into the second direction and a second fabric end unfolded portion extending transversely into the second direction and a second fabric end folded portion folded outwardly into the first direction, whereby the folded portion of the first fabric end is at least partially sandwiched between the unfolded and folded portions of the second fabric end and the folded portion of the second fabric end is at least partially sandwiched between the unfolded and folded portions of the first fabric end, said first and second fabric ends being selectively separable from one another at said overlap section to allow a protrusion to transversely extend there between and between the opening sides, said first and second fabric ends being attached to one another at said attachment sections.

In one embodiment, the folded portions of the first and second fabric ends have free edges terminated in seam finishes.

Typically, both seam finishes are substantially rigid to ensure self-closing of the access opening when in an unused configuration.

Conveniently, both rigidified seam finishes are adapted to allow self-sealing of the access opening around a protrusion member transversely extending therethrough when in a used configuration.

Typically, each seam finish includes an edge cover folded over and stitched to the free edge of the corresponding fabric end. Conveniently, the edge cover is made out of a stretchable material.

Typically, both seam finishes are adapted to substantially partially grip to one another when the first and second fabric ends are pulled transversely away from each other.

In one embodiment, the garment element is a cuff and the access opening is a self-closable thumb port.

Typically, the cuff is adapted in use selectively and partially to cover the palm and back of a hand, the cuff having an extreme distal edge providing a sealing means.

Conveniently, the sealing means includes an elasticized band.

Typically, the cuff is provided with a palm surface formed of reinforced fabric.

In one embodiment, the attachment sections are stitched into the element to locate the access opening correctly.

In one embodiment, first and second fold regions are defined at intersections between the unfolded and folded portions of the first and second fabric ends, respectively.

Typically, the fold region is rigidified and reinforced by stitching.

Typically, the overlap section defines an overlap transversal distance between the first and second fold regions, an aspect ratio of a length of the access opening to the overlap transversal distance being in the range of 2 to 7, and preferably in the range of 3 to 5.

According to another aspect of the present invention, there is provided a garment including at least one garment element as defined hereinabove.

Other objects and advantages of the present invention will become apparent from a careful reading of the detailed description provided herein, with appropriate reference to the accompanying drawings.

BRIEF DESCRIPTION OF THE DRAWINGS

Further aspects and advantages of the present invention will become better understood with reference to the description in association with the following Figures, in which similar references used in different Figures denote similar components, wherein.

DETAILED DESCRIPTION OF THE PREFERRED EMBODIMENTS

With reference to the annexed drawings the preferred embodiments of the present invention will be herein described for indicative purpose and by no means as of limitation.

Figure 1:
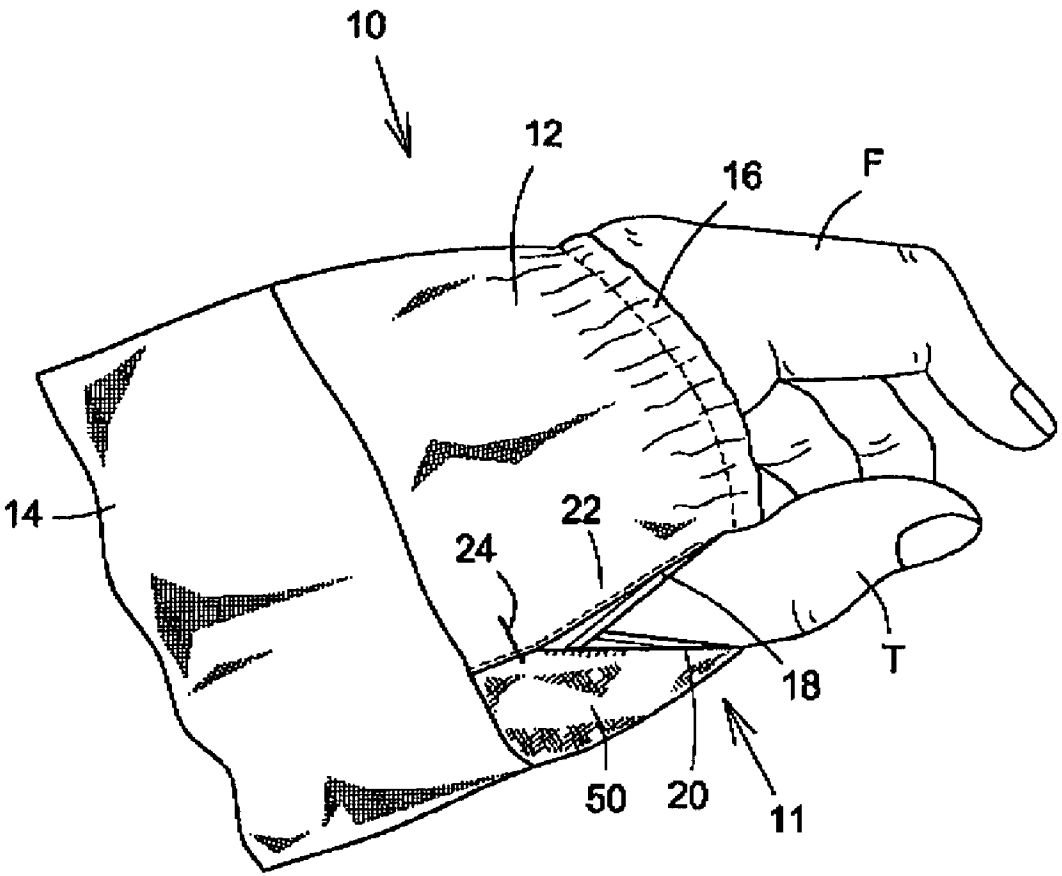
FIG. 1 is a top perspective view of a garment element with an access opening in accordance with an embodiment of the present invention, shown adjacent a cuff and in a used open configuration with a left-hand thumb extending through the access opening.

Referring now in more detail to FIG. 1, there is shown a garment element 10 with an access opening 11 in accordance with an embodiment of the present invention typically located adjacent a cuff 12 of an attendant sleeve portion 14 of the garment. The cuff 12 includes at its distal end an elastic cuff band 16 through which the wearer inserts his forehand F in the process of donning the garment. The access opening or aperture 11 is shown herein as a thumb port in an open used configuration through which the wearer selectively inserts his thumb T in the process of donning the garment. Although the present description focuses on a thumb port 11, one skilled in the art would easily understand that the access opening of the garment element 10 of the present invention could be located on any piece of garment for different uses such as providing selective access to a pocket (not shown) of an underlying garment or the like without departing from the scope of the present invention.

Figure 2:
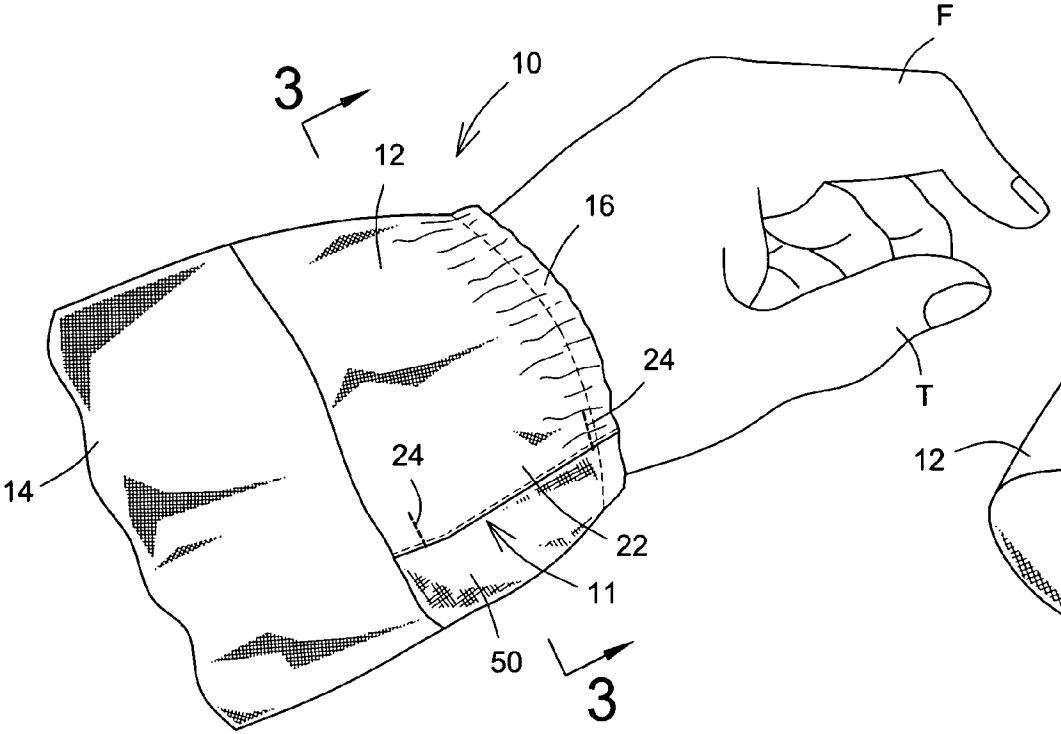
FIG. 2 is a top perspective view of the embodiment of FIG. 1, showing the embodiment of FIG. 1 in an unused closed configuration.

FIG. 2 depicts the garment element 10 with the access opening 11 in a closed unused configuration in which it is substantially invisible to the garment wearer while being generally obstruction less.

Figure 3:
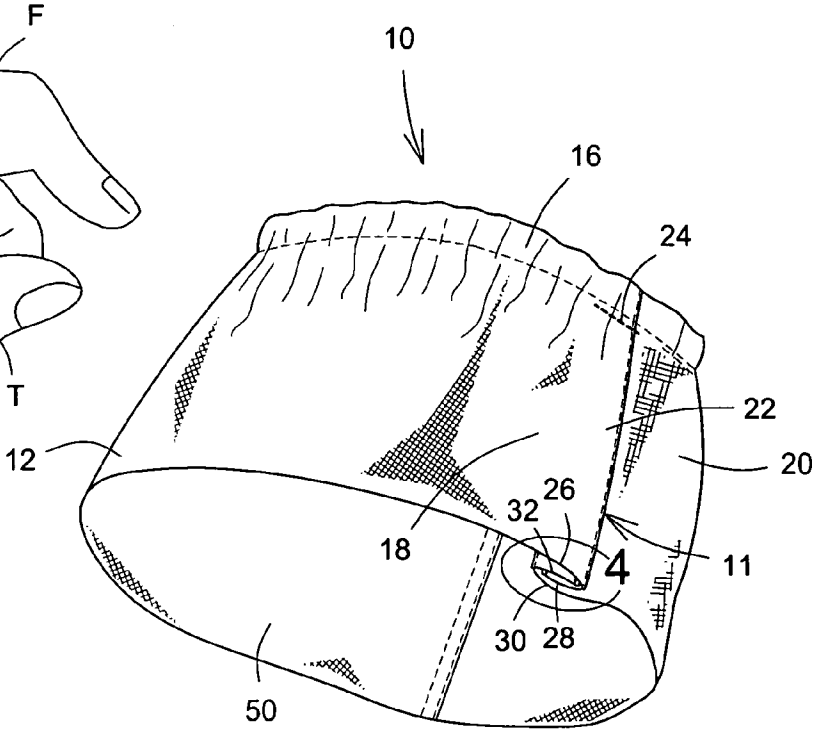
FIG. 3 is a perspective section view taken along line 3-3 of FIG. 2.
Figure 4:
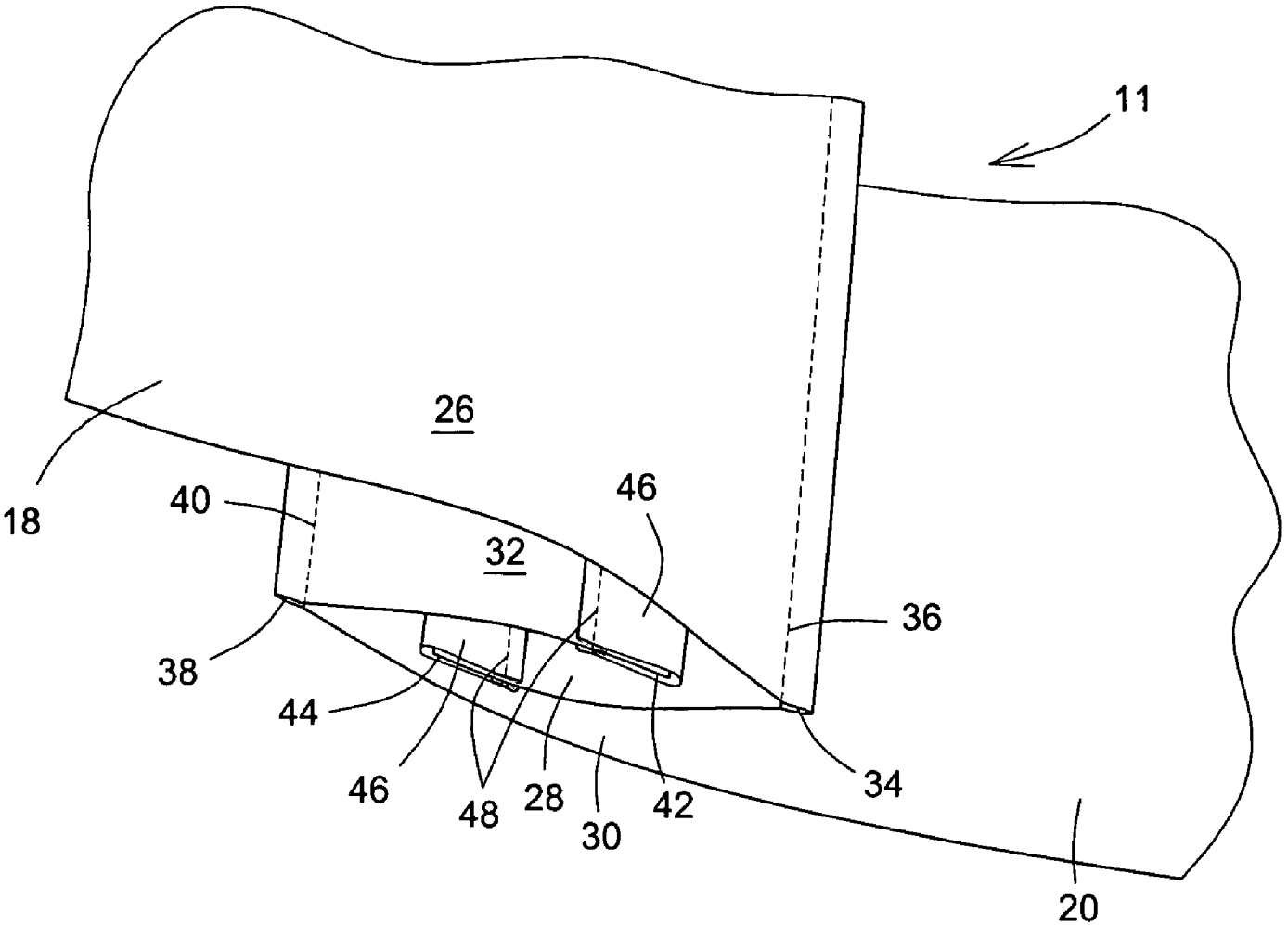
FIG. 4 is a partially broken enlarged top perspective view taken along line 4 of FIG. 3, showing details of the overlap section of the access opening.

As shown more specifically in FIGS. 3 and 4, the access opening 11 is typically elongate and is located at a location wherein the garment has first 18 and second 20 fabric ends extending in generally opposite first and second directions. The opening 11 includes an overlap section 22 extending between two opposite longitudinal attachment sections 24. The overlap section 22 has a first fabric end 18 exterior unfolded portion 26 extending transversely into the first direction and a first fabric end 18 folded portion 28 folded inwardly into the second direction, and a second fabric end 20 interior unfolded portion 30 extending transversely into the second direction and a second fabric end 20 folded portion 32 folded outwardly into the first direction, whereby the folded portion 28 of the first fabric end 18 is at least partially sandwiched between the unfolded 30 and folded 32 portions of the second fabric end 20 and the folded portion 32 of the second fabric end 20 is at least partially sandwiched between the unfolded 26 and folded 28 portions of the first fabric end 18. The first and second fabric ends 18, 20 are selectively separable from one another at the overlap section 22 to allow a protrusion such as a thumb T or the like to transversely extend there between. The first and second fabric ends 18, 20 are attached to one another at the attachment sections 24 using stitching, snaps, buttons, rivets or the like.

Typically, the stitching of attachment sections 24 secures both the exterior fabric end 18 and the interior fabric end 20 in the above described overlap configuration in the proper place on the cuff 12. Although the stitching of the attachment section 24 located adjacent the free end of the cuff 12 is typically spaced apart inwardly from interior edge of the elastic band 16 by a distance of between about zero and about one inch, preferably about ½ inch.

As illustrated more specifically in FIG. 4, a first fold region 34 defined at an intersection between the unfolded 26 and folded 28 portions of the first fabric end 18 is typically rigidified, and also reinforced, by a stitching 36, permanent fold line or the like that extends at least partially there along, preferably all along the overlap section 22. Similarly, a second fold region 38 defined at an intersection between the unfolded 30 and folded 32 portions of the second fabric end 20 is typically rigidified by a stitching 40, permanent fold line or the like. The rigidifying stitching 36, 40 help in keeping the access opening 11 closed when in the unused configuration by keeping the folding or "sandwich effect" thereof. To a certain extent, they also help ensuring a self-sealable opening 11 in the open used configuration by keeping the first and second fabric ends 18, 20 tight against the thumb T when the later extends there between through the access opening 11.

The free edges 42, 44 of the respective folded portions 28, 32 of the first and second fabric ends 18, 20 are typically nicely terminated and rigidified using conventional seam finishes in the art to prevent deterioration, for example by fraying, tearing or defibering thereof. The seam finishes typically give some rigidity to ensure proper self-closing of the opening 11 and self-sealing thereof in the open used configuration by keeping the first and second fabric ends 18, tight against the thumb T (or other protrusion) when the later extends there between through the access opening 11, because of their resiliency or "shape memory" effect. The rigid free edges 42, 44 also help keeping the opening 11 closed by having their seam finishes substantially partially gripping to one another when the two fabric ends 18, 20 are being pulled transversely away from each other. Typically, each seam finish includes an edge cover 46 folded over and stitched to the free edge 42, 44 of the corresponding fabric end 18, 20, via stitches 48. The edge cover 46 could be made out of a similar material than the corresponding fabric or a different material such as but by no means as of limitation a stiffer or reinforced material, and eventually a resilient or stretchable material that could provide a certain seal against water or the like such as rubber, neoprene or the like for more specific use by sailors and/or bikers.

The overlapping orientation of the inwardly folded exterior first fabric end 18 over the outwardly folded interior second fabric end 20 are patterned in such a manner as to provide maximal deflection capabilities when the cuff 12 is positioned in a substantially horizontal orientation (such as during cycling or the like), in a substantially vertical orientation (such as during walking or the like) or anywhere in between. The orientation opposes vertically gravitationally-induced weather intrusions and/or similarly opposes horizontally (in a rearward direction) windward penetration induced weather intrusions, respectively. The overlapping configuration is also effective in preventing insects egress into the access opening 11 and serves to efficiently and securely close the thumb port 11 once the thumb T is inwardly retracted there from by making the access opening 11 generally self-closable.

FIGS. 3 and 4 also disclose the downward orientation of the exterior first fabric end 18 overlapping the interior second fabric end 20 to further illustrate the self-sealable characteristic of the access opening 11 in the closed unused configuration.

Figure 5:
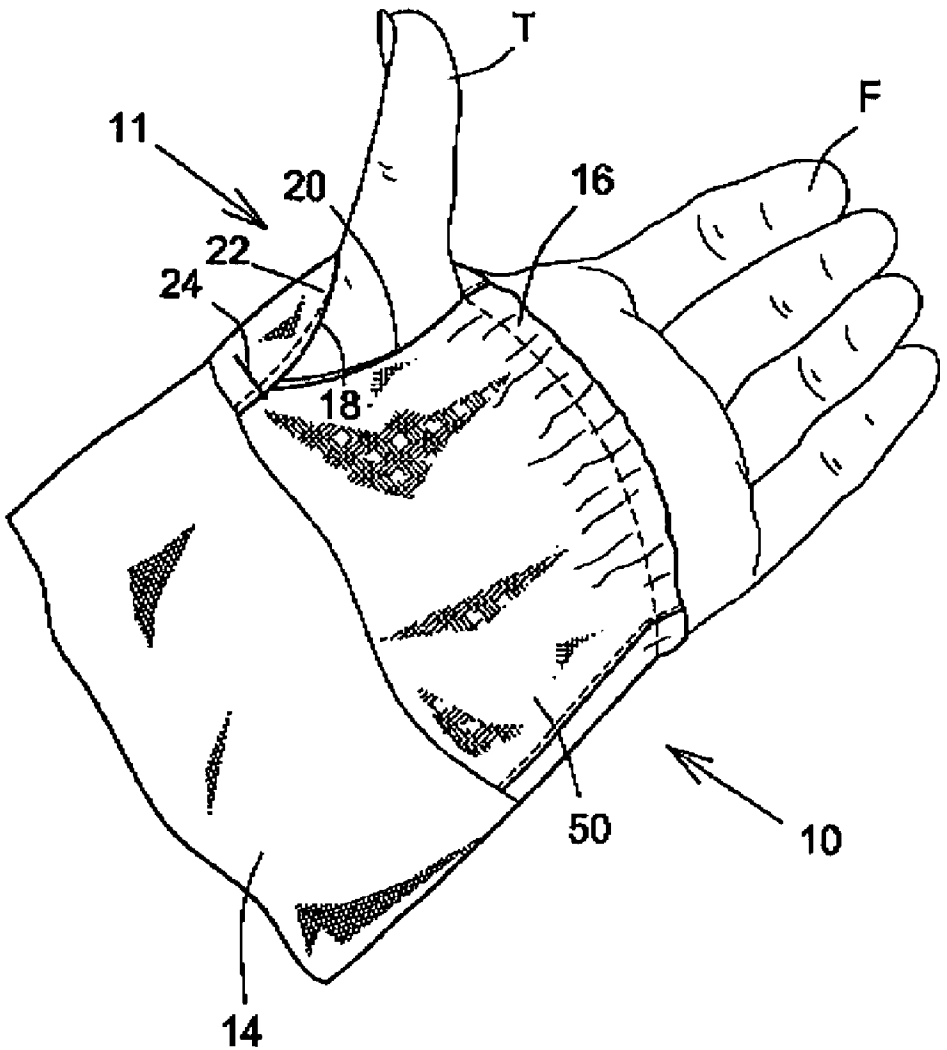
FIG. 5 is a bottom perspective view of the embodiment of FIG. 1, showing the palm side of the cuff with reinforced fabric.

FIG. 5 is a depiction of the palm side of the cuff 12 illustrating that the second fabric end 20 is part of a typically reinforced fabric 50 extending over the palm surface of the cuff 12 intended to make said cuff 12 more durable and protective to the wearer in the event that the garment is destined for recreational use, use in sport, or labor or the like related application.

Obviously, the self-closable and self-sealable features of the access opening 11 depend on the aspect ratio of the opening length of the overlap section 22 over an overlap transversal distance between the first and second fold regions 34, 38. Typically, the aspect ratio is between about two to seven (2-7), preferably about three to five (3-5).

Although the present invention has been described with a certain degree of particularity, it is to be understood that the disclosure has been made by way of example only and that the present invention is not limited to the features of the embodiments described and illustrated herein, but includes all variations and modifications within the scope and spirit of the invention as hereinafter claimed.

I claim:

1. A garment element comprising:

first and second fabric ends extending in generally opposite first and second directions;

an elongate access opening defined by said fabric ends and extending between two separate, longitudinally opposite attachment sections, said first and second fabric ends being attached to one another at said attachment sections, each attachment section forming one side of said opening, said access opening including:

an overlap section having a first fabric end unfolded portion extending transversely into the first direction and a first fabric end folded portion folded inwardly into the second direction and a second fabric end unfolded portion extending transversely into the second direction and a second fabric end folded portion folded outwardly in the first direction, whereby the folded portion of the first fabric end is at least partially sandwiched between the unfolded and folded portions of the second fabric end and the folded portion of the second fabric end is at least partially sandwiched between the unfolded and folded portions of the first fabric end;

said first and second fabric ends being selectively separable from one another at said overlap section to allow a protrusion member to transversely extend therebetween and between said attachment sections.

2. The garment element of claim 1 wherein the folded portions of the first and second fabric ends have free edges terminated in seam finishes.

3. The garment element of claim 2 wherein both seam finishes are substantially rigid to ensure self-closing of the access opening when in an unused configuration.

4. The garment element of claim 3 wherein both rigidified seam finishes are adapted to allow self-sealing of the access opening around a protrusion member transversely extending therethrough when in a used configuration.

5. The garment element of claim 4 wherein each seam finish includes an edge cover folded over and stitched to the free edge of the corresponding fabric end.

6. The garment element of claim 5 wherein the edge cover is made out of a stretchable material.

7. The garment element of claim 2 wherein each seam finish includes an edge cover folded over and stitched to the free edge of the corresponding fabric end.

8. The garment element of claim 1 wherein the garment element is a cuff and the access opening is a self-closable thumb port.

9. The garment element of claim 8 wherein the cuff is adapted in use selectively and partially to cover the palm and back of a hand, the cuff having an extreme distal edge providing a sealing means.

10. The garment element of claim 9 wherein the sealing means includes an elasticized band.

11. The garment element of claim 8 wherein the cuff is provided with a palm surface formed of reinforced fabric.

12. The garment element of claim 1 wherein the attachment sections are stitches.

13. The garment element of claim 1 wherein first and second fold regions are defined at intersections between the unfolded and folded portions of the first and second fabric ends, respectively.

14. The garment element of claim 13 wherein the fold region is rigidifled.

15. The garment element of claim 14 wherein the fold region is rigidified and reinforced by stitching.

16. The garment element of claim 13 wherein the overlap section defines an overlap transversal distance between the first and second fold regions, an aspect ratio of a length of the access opening to the overlap transversal distance being in the range of 2 to 7.

17. The garment element of claim 16 wherein the aspect ratio is in the range of 3 to 5.

18. A garment including at least one garment element according to claim 1.

* * * * *